US010787892B2

(12) United States Patent
Legg et al.

(10) Patent No.: US 10,787,892 B2
(45) Date of Patent: Sep. 29, 2020

(54) IN SITU SRF CAVITY PROCESSING USING OPTICAL IONIZATION OF GASES

(71) Applicant: JEFFERSON SCIENCE ASSOCIATES, LLC, Newport News, VA (US)

(72) Inventors: Robert Legg, Newport News, VA (US); Thomas Powers, Poquoson, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 0 days.

(21) Appl. No.: 16/568,370

(22) Filed: Sep. 12, 2019

(65) Prior Publication Data

US 2020/0088018 A1 Mar. 19, 2020

Related U.S. Application Data

(60) Provisional application No. 62/733,104, filed on Sep. 19, 2018.

(51) Int. Cl.

| | |
|---|---|
| ***H05H 7/20*** | (2006.01) |
| ***E21B 36/04*** | (2006.01) |
| ***E21B 43/247*** | (2006.01) |

(52) U.S. Cl.

CPC ..... *E21B 43/247* (2013.01); *E21B 36/04* (2013.01); *H05H 7/20* (2013.01)

(58) Field of Classification Search

CPC ..... H05H 7/20; H05H 7/18; H05H 2007/043; H05H 7/00; H05H 9/044; H01L 39/24

USPC ..... 250/492.21, 492.1; 333/99 S

See application file for complete search history.

(56) References Cited

U.S. PATENT DOCUMENTS

| | | | | |
|---|---|---|---|---|
| 4,765,055 | A * | 8/1988 | Ozaki | H01L 39/24 29/599 |
| 5,248,662 | A | 9/1993 | Yoshida et al. | |
| 5,597,762 | A * | 1/1997 | Popovici | H01J 9/022 438/105 |
| 5,736,709 | A | 4/1998 | Neiheisei | |
| 6,097,153 | A * | 8/2000 | Brawley | H05H 7/20 219/121.63 |
| 9,006,147 | B2 * | 4/2015 | Taylor | C25F 3/26 505/300 |

(Continued)

OTHER PUBLICATIONS

Gam Laser Inc., "VUV 157 nm Fluorine Lasers", Orlando, FL 2005.

(Continued)

*Primary Examiner* — David A Vanore

(57) ABSTRACT

A system and method for the in situ processing of internal SRF cavity surfaces to reduce field emission and improve maximum gradient. An electromagnetic radiation source is introduced in the bore of a superconducting cavity to enhance ionization or dissociation of gases which then remove contaminants from the surface of the cavity, either through direct surface bombardment, chemical reaction or through the production of radiation which interacts with the contaminants. An RF or low frequency electromagnetic field may be established in the cavity which further enhances the ionization or dissociation process and may cause the ions to bombard sites with enhanced electric fields. The invention removes the requirement that the RF field be sufficient by itself to ionize gas in the cavity.

11 Claims, 1 Drawing Sheet

(56) References Cited

U.S. PATENT DOCUMENTS

| | | | | |
|---|---|---|---|---|
| 9,362,802 | B2 * | 6/2016 | Jordan | H02K 7/1807 |
| 9,655,227 | B2 * | 5/2017 | Wang | H05H 9/044 |
| 10,485,090 | B2 * | 11/2019 | Myneni | H05H 7/20 |
| 2005/0161749 | A1 * | 7/2005 | Yang | G01P 15/08 257/414 |
| 2008/0106261 | A1 * | 5/2008 | Romalis | G01R 33/441 324/304 |
| 2016/0147161 | A1 * | 5/2016 | Nikipelov | G21K 1/10 355/67 |
| 2020/0029420 | A1 * | 1/2020 | Ylimaki | H05H 6/00 |
| 2020/0088018 | A1 * | 3/2020 | Legg | E21B 43/247 |

OTHER PUBLICATIONS

Jiquan Guo, Haipeng Wang, "Analytical Estimate of the RF Cavity Field vs. Waveguide Field for Cavity Plasma Cleaning Operation", JLAB-TN-13-005, Jan. 2013.

R Legg, et al., "Plasma Processing of a 200 MHz Superconducting Electron Gun", JLAB Tech Note 13-030, (2013).

M. Doleans, et al., In-situ plasma processing to increase the accelerating gradients of superconducting radio-frequency cavities, NIMA, vol. 812, Mar. 11, 2016, pp. 50-59.

A. FenneHy, D.G. Torr, Photoionization and pholoabsorption cross sections of O, N2, O2, and N for aeronomic calculations, Atomic Data and Nuclear Data Tables, vol. 51, Issu.

C. Hernandez-Garcia, "DC gun high voltage processing with Krypton gas", JLAB Tech Note 08-065, (2008).

P.V. Tyagi, et al., Improving the work function of the niobium surface of SRF cavities by plasma processing, Applied Surface Science 369 (2016), p. 29-35.

* cited by examiner

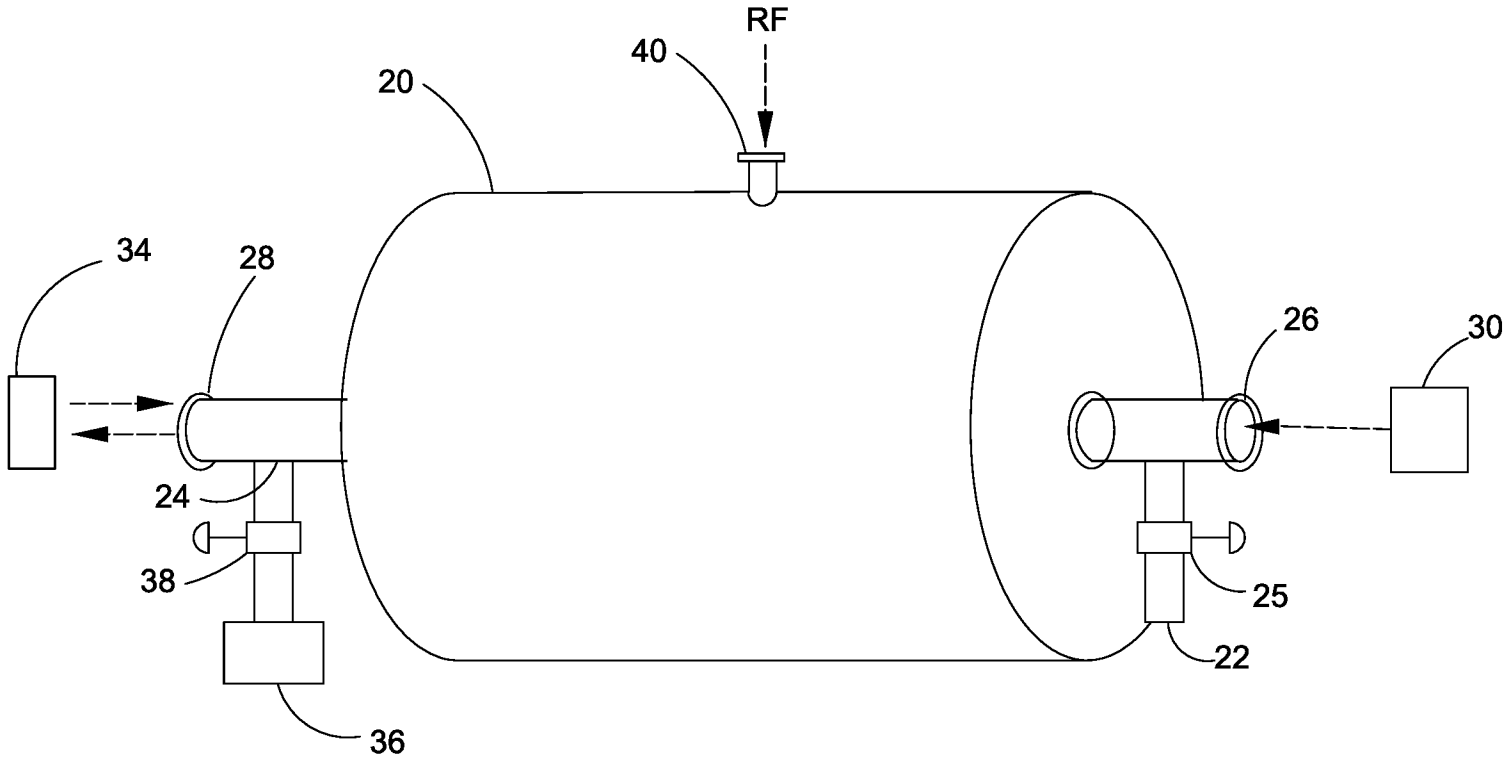
30
26
25
22
RF
40
20
36
28
24
38
34

IN SITU SRF CAVITY PROCESSING USING OPTICAL IONIZATION OF GASES

This application claims the priority of Provisional U.S. Patent Application Ser. No. 62/733,104 filed Sep. 19, 2018.

The United States Government may have certain rights to this invention under Management and Operating Contract No. DE-AC05-06OR23177 from the Department of Energy.

FIELD OF THE INVENTION

The present invention relates to the improving the accelerating gradients of superconducting radio-frequency (SRF) cavities and more particularly to the in situ processing of internal SRF cavity surfaces to reduce field emission and improve maximum gradient.

BACKGROUND OF THE INVENTION

Existing in situ processing schemes include several disadvantages as they either depend on keeping the cavity cold enough to remain superconducting (<9 K) so the field remains high in the cavity compared to the coupler, use helium (one of the few materials that are capable of remaining in a gaseous state) as a working gas, or require a modified RF coupler to match to the cavity at room temperature to ionize the working gas in the cavity rather than breaking down in the coupler. Helium processing is of limited value in bombarding field emission sites due to its low molecular weight and its inability to chemically scrub the cavity due to its non-reactive nature. Using an RF coupler designed to couple RF energy into the cavity while it is non-superconducting only works for a limited number of coupler types and for a limited range of coupling factors. Additionally, conventional plasma cleaning methods are limited to processing only one cell of an RF structure at a time rather than the entire structure. Removal of the cold couplers from the cavity is very difficult to accomplish outside a clean room in a particle-free manner and in many cryomodules would require a complete re-work of the cryomodule which would cost millions of dollars. A major problem with clean room processing is the undesirable introduction of particles into the cavity, which is a major source of field emission. The use of a clean room excludes in situ processing of the cryomodule cavities.

Accordingly, it would be desirable to provide a safe, economical, method for in situ processing of internal SRF cavity surfaces to reduce field emission and improve maximum gradient.

OBJECT OF THE INVENTION

It is therefore an object of the present invention to provide an in situ SRF cavity processing method that enables simultaneous processing of the surfaces of an entire RF structure rather than processing one cell at a time.

A further object of the invention is to eliminate the need for disassembly of cryomodules and the transferal of SRF cavities to a clean room in order to reestablish their operating gradients.

A further object of the invention is to provide an in situ SRF cavity processing method that can be carried out at room temperature.

Another object of the invention is to provide a safe, economical, method for in situ processing of internal SRF cavity surfaces to reduce field emission and improve maximum gradient of the cavities.

These and other objects and advantages of the present invention will be understood by reading the following description along with reference to the drawings.

SUMMARY OF THE INVENTION

The invention is a method for in situ processing of internal SRF cavity surfaces to reduce field emission and improve maximum gradient. An electromagnetic radiation source is introduced into the bore of a superconducting cavity to ionize, or cause dissociation of, gases which then remove contaminants from the surface of the cavity, either through direct surface bombardment, chemical reactions, or through the production of radiation which interacts with the contaminants. An RF or low frequency electromagnetic field may be established in the cavity which further enhances the ionization process and may cause the ions to bombard sites with enhanced electric fields. The invention removes the requirement that the RF field be sufficient by itself to ionize gas in the cavity. The in situ processing method would also enable exposure of the entire internal surface of multiple cells in an RF structure to ionize gas simultaneously rather than on a cell by cell basis.

BRIEF DESCRIPTION OF THE SEVERAL VIEWS OF THE DRAWING(S)

Reference is made herein to the accompanying drawings, which are not necessarily drawn to scale, and wherein:

FIG. 1 is a schematic depicting in situ SRF cavity processing using optical ionization of gases according to the current invention.

DETAILED DESCRIPTION

The present invention is a system and method to allow SRF cavities to have internal cavity surfaces processed in situ to reduce field emission and improve maximum gradient.

The invention allows for SRF cavities to be processed at room temperature after assembly without disassembly of the cavity vacuum space. The invention involves the use of two or more flanges with gas inlets, pump ports to flow gas through the structure, and optical windows mounted outboard of the in-process structure's upstream and downstream valves. One of the flanges has a window, such as MgF2, LiF, quartz, or sapphire, transparent at the wavelength of the radiation used to ionize the gas, while the other flange has either a steerable mirror which allows the radiation to be retro reflected through the cavity, a radiation beam dump for the exiting radiation, or is transparent to the incident radiation, in which case an external beam dump may be necessary. In addition, the optics used may allow the radiation to be focused, which allows the radiation beam to be large at the optical window but go through a waist in the specific region of the structure being processed.

As shown in FIG. 1, a system to achieve in situ SRF cavity processing using optical ionization of gases includes a structure 20 having an inlet 22 for gas, which may be filtered. The system preferably includes a throttling valve 25, an optical port 26, and potentially a second optical port 28. A radiation source 30 includes a high power density and a wavelength short enough to ionize the gas. The term "high power density" as used herein means power densities between 10 mW/cm$^2$ to 1000 W/cm$^2$. The term "wavelength short enough to ionize the gas" as used herein means wavelengths below 400 nm. The radiation source 30 may be an excimer pulsed laser using a fluorine system at 157 nm, which would be compact, but other gases and radiation sources would also work. The optical port 28 may include a mirror 34 which reflects the electromagnetic radiation and provides a means for monitoring the progress of the in situ process. The gas flow exits the structure through the pump out port 24. A vacuum pump 36 may include a valve 38 on its inlet to enable further throttling of the gas flow rate through the structure in order to control the pressure in the structure 20 during the cavity processing. Additionally, radio frequency or low frequency electromagnetic fields may be applied inside the cavity through one or more ports 40 to enhance ionization and dissociation of gases or the cavity cleaning process.

The in situ system of the present invention allows the structure to remain semiconductor grade clean by placing a set of clean optical elements outside the structure gate valves and then pumping those out before the structure valves are opened. All hardware used in the cleaning process is external to the structure gate valves.

As an example, a structure having a 10*m* length is subjected to in situ refurbishing according to the invention. Vacuum tees are installed on the structure being processed according to ISO 5 standards. One of the tees is attached to a clean vacuum pump to allow gas to be pumped through the structure. The gas used to process the cavity is a mixture of a higher atomic weight noble gas, such as helium (He), neon (Ne), argon (Ar), krypton (Kr), xenon (Xe), radon (Rn), or oganesson (Og), with a small percentage of a potentially reactive gas such as $O_2$ a fraction of which is dissociated in the plasma forming reactive atomic and ionic oxygen atoms. The gas is preferably filtered and introduced into the module. Flow is controlled using a mass flow controller or other variable valve assembly. The vacuum pump has a valve on its inlet to allow the gas flow rate through the structure to be throttled and in order to control the pressure in the structure during the process. The radiation source is attenuated and the optical path of the radiation source may be adjustable so that, for example, it is kept on the centerline of the structure. In this example the pressure in the cavity will be maintained between 10 to 1000 milliTorr (mT). The noble gas may include a reactive gas such as $O_2$, $ArF_2$, and ArCl. As an example in which the reactive gas is $O_2$, the reactive $O_2$ preferably comprises 0.2% to 99.9% of the noble gas/reactive gas mixture.

The photoionization cross section for $O_2$ is about $1\times10^{-8}$ at 6.3 eV. At 100 mT pressure and room temperature, and assuming the gas used behaves according to the ideal gas law, the number of moles in the 6 by 3 mm path of the optical radiation projected down the 10 meter length of the structure, can be calculated by n=PV/RT, or about $1\times10^{-3}$ moles, where P is the pressure, V is the volume, R is Avogadro's number and a T is the absolute temperature.

Multiplying by Avogadro's number, $6.02\times10^{23}$, to get the number of molecules, about $6\times10^{20}$ molecules are in the interaction volume. A 10 watt source at 150 nm would produce about $1\times10^{19}$ photons. Multiplying this by the cross section, the number of ions produced is about $6\times10^{11}$ per second. This number of ions is sufficient to couple RF coming through the coupler into the cavity. It also will allow the ions produced to back-bombard cavity surface imperfections which have enhanced electric field. In addition the oxygen ions scavenge carbon and hydrocarbons from the Nb surfaces which has the effect of increasing the surface work function. This is only one example of a possible combination of gas and radiation source, but represents many other possible combinations described by the invention. The efficacy of the process is monitored by measuring the concentration of carbon or other species in the exhaust gas either spectroscopically or by a mass spectrometer, such as a residual gas analyzer (RGA).

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for processing a superconducting radio-frequency (SRF) cavity structure to reduce field emission and improve maximum gradient, comprising:

introducing gas into the structure;

operating a vacuum pump to pull the gas through the structure;

controlling the pressure of the gas in the structure to 10 to 1000 milliTorr;

introducing radiation into the structure to ionize the gas, said radiation having a power density between 10 $mW/cm^2$ and 1000 $W/cm^2$; and establishing a radio frequency (RF) or low frequency electromagnetic field in the structure to enhance the ionization of the gas.

2. The method of claim 1 comprising reflecting the radiation back through the structure to further enhance ionization and dissociation of the gas.

3. The method of claim 1 comprising the radiation is selected from the group consisting of ultraviolet photon radiation and visible photon radiation.

4. The method of claim 1 comprising the radiation includes a wavelength less than 400 nm.

5. The method of claim 1 comprising the radiation includes a wavelength of 157 nm.

6. The method of claim 1 comprising exhausting a portion of the gas from the structure.

7. The method of claim 6 comprising measuring the concentration of carbon in the exhaust gas to monitor the efficacy of the ionization and ionization and dissociation process.

8. The method of claim 1 comprising the gas is a mixture of a higher weight noble gas and a reactive gas.

9. The method of claim 8 wherein the higher atomic weight noble gas is selected from the group consisting of helium (He), neon (Ne), argon (Ar), krypton (Kr), xenon (Xe), radon (Rn), and oganesson (Og).

10. The method of claim 8 wherein the reactive gas is selected from the group consisting of oxygen, argon fluoride, and argon chloride.

11. The method of claim 8 comprising the reactive gas is 0.2% to 99.9% of the gas mixture.

* * * * *